US006326731B1

(12) United States Patent
Robinson et al.

(10) Patent No.: US 6,326,731 B1
(45) Date of Patent: Dec. 4, 2001

(54) SOCKET AND BALLAST FOR GAS DISCHARGE LAMP

(75) Inventors: Herbert L. Robinson, Potomac, MD (US); Robert C. Smallwood; David E. Bachschmid, both of Leesburg, VA (US)

(73) Assignee: Logic Laboratories, Inc., VA (US)

( * ) Notice: Subject to any disclaimer, the term of this patent is extended or adjusted under 35 U.S.C. 154(b) by 0 days.

(21) Appl. No.: 09/587,696

(22) Filed: Jun. 5, 2000

Related U.S. Application Data

(63) Continuation of application No. 08/826,378, filed on Apr. 9, 1997, now abandoned, which is a continuation of application No. 08/520,881, filed on Aug. 30, 1995, now abandoned.

(51) Int. Cl.[7] ..... F21V 23/00

(52) U.S. Cl. ..... 315/56; 315/58; 362/221; 362/260; 439/226; 439/236

(58) Field of Search ..... 315/56, 58, 71; 362/221, 217, 260; 439/226, 231, 236, 232, 241, 414, 419, 336

(56) References Cited

U.S. PATENT DOCUMENTS 2,284,376 * 5/1942 Reamer et al. .
5,253,152 * 10/1993 Yang et al. ..... 362/221

* cited by examiner

*Primary Examiner*—David Vu
(74) *Attorney, Agent, or Firm*—Sofer L Maroun, LLP

(57) ABSTRACT

A lamp socket is provided which contains a ballast, or lamp driver which remains in the socket when the tube is replaced and supports the gas discharge tube. The lamp socket includes connectors for attachment to the gas discharge tube, lamp driver circuitry including an oscillator, power semiconductors, and protective and filter circuitry, and a housing containing the lamp driver circuitry including an oscillator, power semiconductors, and protective and filter circuitry.

6 Claims, 4 Drawing Sheets

SOCKET AND BALLAST FOR GAS DISCHARGE LAMP

RELATED DATA

This application is a continuation of Applicant's currently U.S. patent application Ser. No. 08/826,378 filed Apr. 9, 1997, now abandoned which is a continuation of Applicant's abandoned U.S. patent application Ser. No. 08/520,881 filed Aug. 30, 1995, both of which are incorporated by reference herein as fully as if set forth in their entirety.

BACKGROUND OF THE INVENTION

1. Field of the Invention

The present invention relates to an improvement in the construction of ballasts for gas discharge lamps. More particularly, the present invention pertains to a socket, or sockets, for a gas discharge tube which contains the lamp driver portion of the system.

2. Background of the Invention

The lamp driver portion of an electronic ballast includes an oscillator, power semiconductors, and associated protection and filter circuits. Conventional systems arrange the circuitry in several configurations. For example, in copending patent application Ser. No. 08/496,623 for a gas discharge lamp and power distribution system filed Jun. 29, 1995, which depends from patent application Ser. No. 08/116,150 filed Sep. 2, 1993, incorporated herein by reference, both circuitry internal to the gas discharge tube and as a conformal extension of the tube are disclosed.

Other patents have differing circuitry arrangements. U.S. Pat. No. 5,294,865 to Haraden, for a lamp with integrated electronic module, has the ballast in the lamp base, which in turn screws into a conventional incandescent socket. U.S. Pat. No. 5,289,079 to Wittmann shows a compact fluorescent lamp and base combination, and U.S. Pat. No. 4,862,035 to Cunliffe et al teaches a fluorescent lamp unit having plural separate tubes and a particular arrangement of circuit elements. Both Wittmann and Cunliffe et al have starting circuitry in the compact fluorescent lamp base.

U.S. Pat. No. 5,086,249 to Blaisdell et al relates to a compact discharge lamp unit in which space is provided in the lamp base for a ballast. A ballast is attached to the side of the lamp base for a circular fluorescent lamp in a device according to U.S. Pat. No. 4,316,120 to Cotman et al, and U.S. Pat. No. 4,258,287 to Hetzel. In all of the foregoing arrangements, the lamp base screws into a socket, and when the lamp is replaced the ballast is replaced as well.

Since the average gas discharge lamp has a life expectancy significantly less than the life expectancy of the ballast, a ballast in perfectly good working order is discarded with the spent gas discharge lamp. Furthermore, the ballast adds significantly to the cost of the gas discharge lamp.

SUMMARY OF THE INVENTION

It is, therefore, an object of the present invention to provide socket and ballast for a gas discharge lamp, in which the ballast is separated from the gas discharge lamp, and is built into the socket.

It is another object of the present invention to reduce the cost of gas discharge lamps by removing the ballast from the lamp.

Yet another object of the present invention is take advantage of the greater life expectancy of the ballast as compared to the gas discharge lamp so that each element is used throughout its working life.

Still another object of the present invention is to eliminate the need for separate wiring for the lamp dimer, thereby simplifying installation and reducing costs.

These and other objects of the present invention and the deficiencies of the prior art are addressed by the present invention which is directed to an arrangement where the ballast, or lamp driver, is disposed in the lamp socket, which supports the gas discharge lamp, and remains in the socket when the lamp is replaced.

BRIEF DESCRIPTION OF THE DRAWINGS

These and other attributes of the present invention will be described with respect to the following drawings in which.

DETAILED DESCRIPTION OF THE INVENTION

Since the lamp driver typically has a life comparable to or greater than that of the lamp, separation of the lamp driver from the gas discharge tube can produce considerable savings. Furthermore, the elimination of separate wiring for the driver simplifies installation and reduces costs. The typical socket for a gas discharge tube is made of a non-conductive material such as ceramic or plastic. It also contains a spring metal contact or series of contacts which are connected to wires or wiring connectors in the base. The socket also has mounting provisions in its base where it is attached to the fixture for holding a lamp or group of lamps. There is also a spring loaded arrangement for allowing the initial insertion of lamp electrical contacts to permit engagement with the socket contacts.

Figure 1:
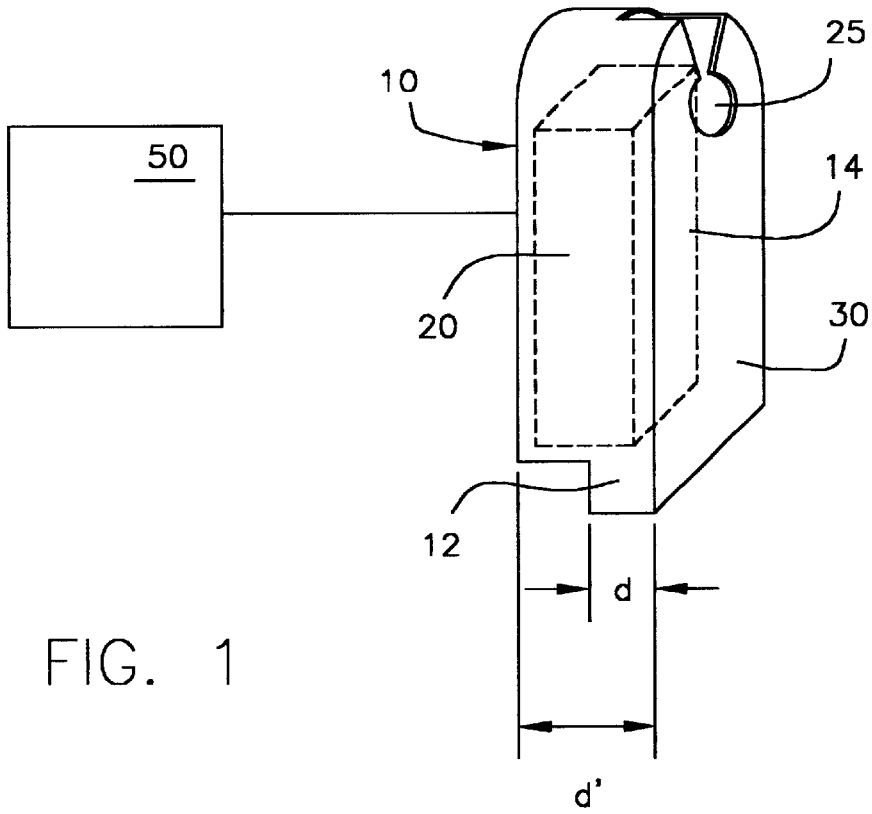
FIG. 1 is a perspective view of a first embodiment of the present invention.
Figure 2:
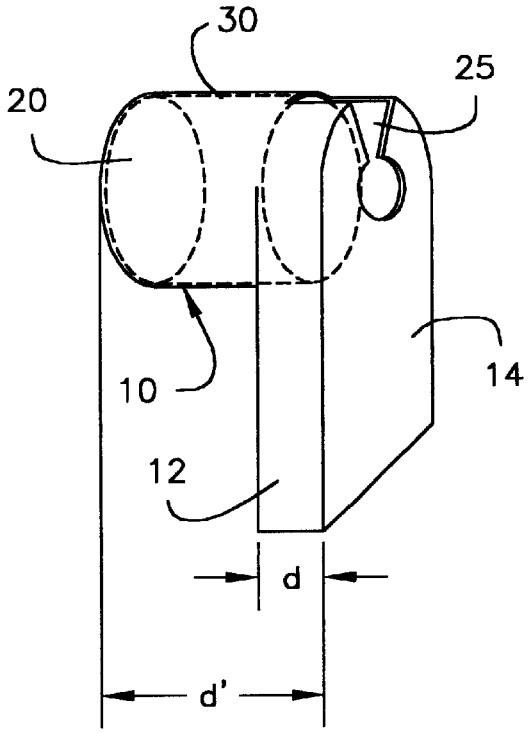
FIG. 2 is a perspective view of a second embodiment of the present invention.

Referring to the drawings, FIGS. 1 and 2 show first and second embodiments of a lamp socket 10 according to the present invention. The lamp socket 10 is designed so that the lamp driver 20 is disposed in the socket 10 for the gas discharge tube (not shown) and remains when the lamp is replaced. In both the first and second embodiments the depth of the socket is increased to accommodate the lamp driver 20.

In FIG. 1, the lower portion 12 of the housing 30 of the socket 10 has a depth d. The remainder of the housing 30 of the socket 10, above the lower portion 12, has an increased depth d'. The depth d of the lower portion 12 corresponds to the depth of a standard socket. While the first embodiment shown in FIG. 1, has the depth of nearly the entire housing 30 of the socket 10 increased, the second embodiment, shown in FIG. 2, has only a cylindrical portion of the housing 30 behind the contacts 25, (or the slot for connection to the gas discharge tube) increased to a depth d'. The depth of the housing 30 can be increased in various other configurations, proportions and shapes. The depth of the housing 30 of the socket 10 increases in a direction facing away from the gas discharge tube. As a result the socket presents a smooth face 14 towards the tube.

Figure 3C:
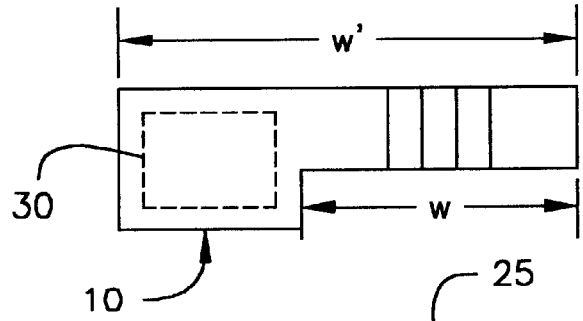
FIGS. 3*a*, 3*b*, and 3*c* are a top view, end view and perspective view of a third embodiment of the present invention.
Figure 3B:
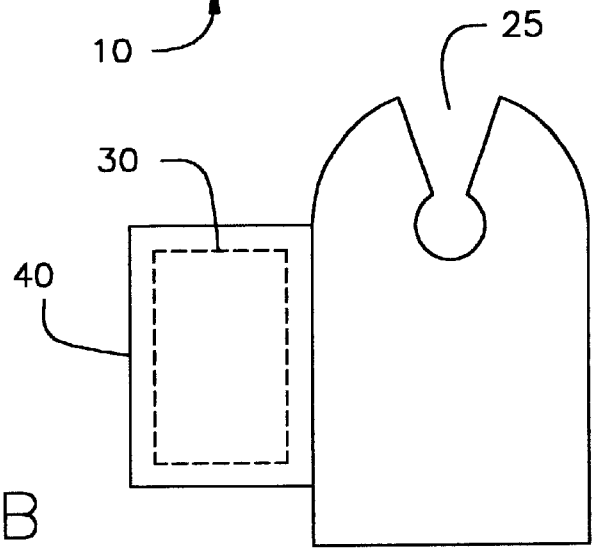
Figure 3A:
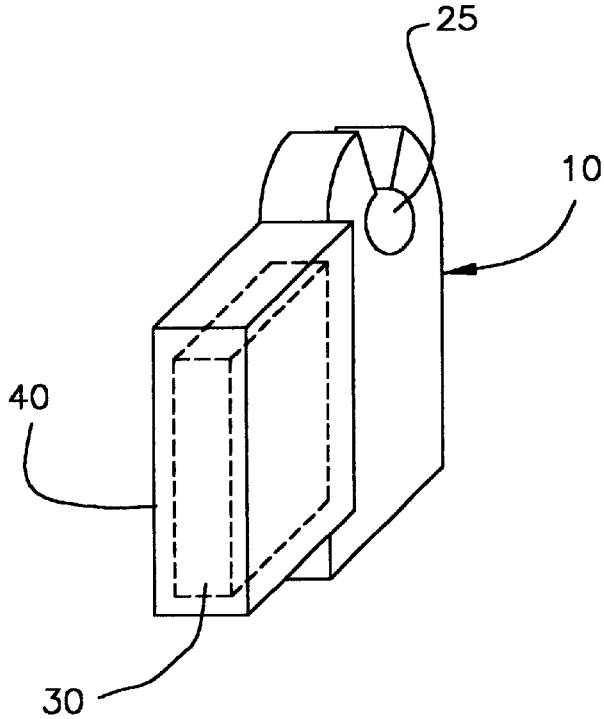
Figure 4B:
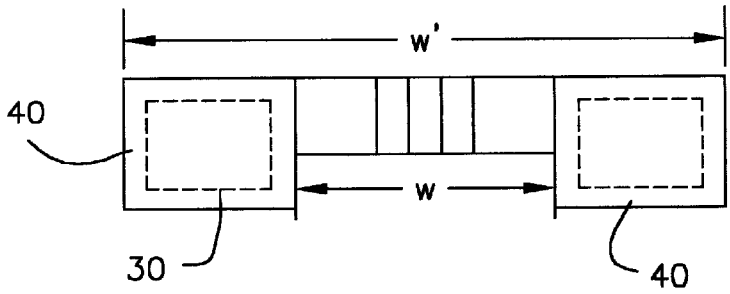
FIGS. 4*a*, 4*b*, and 4*c* are a perspective view, a top view and an end view of a forth embodiment of the present invention.
Figure 4C:
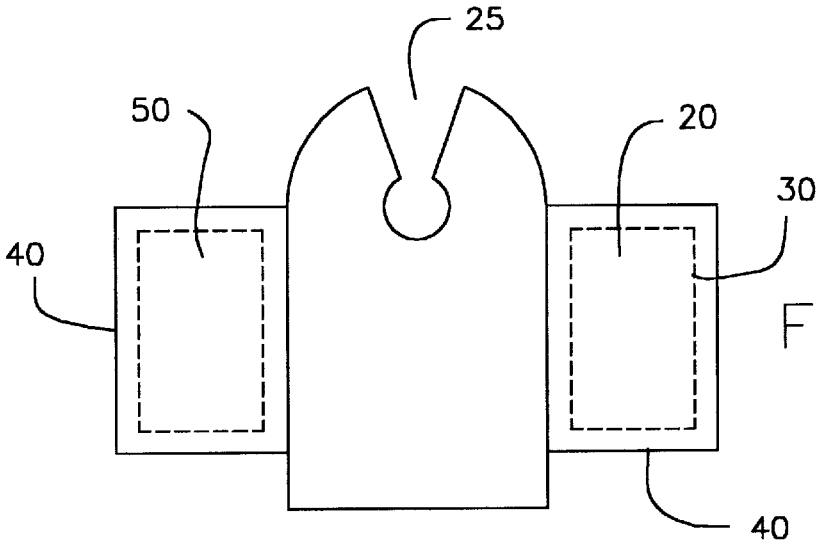
Figure 4A:
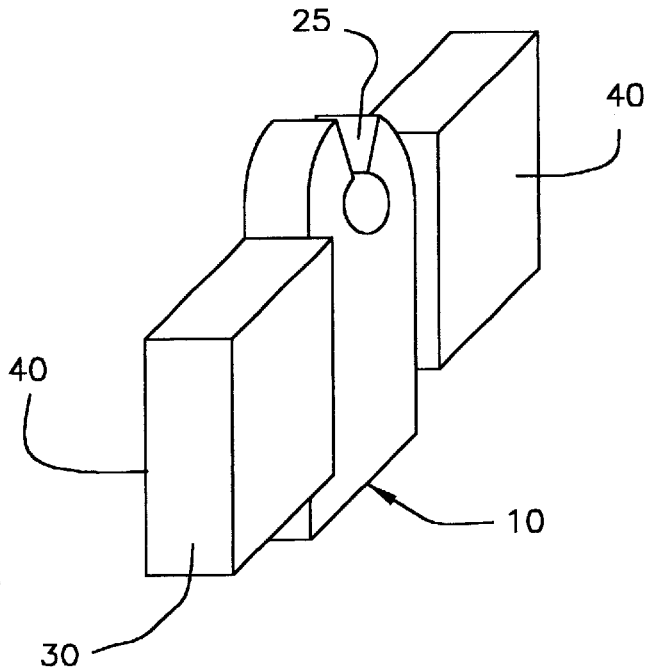

FIGS. 3*a–c* show a third embodiment of the present invention, and FIGS. 4*a–c* show a fourth embodiment of the present invention. In these embodiments the sockets 10 are intended for use in situations where it is not possible or feasible to increase the depth d of the socket 10 because of space limitations. In these cases the housing 30 has an expanded portion 40 alongside the socket 10, increasing the width. In FIG. 3 the expanded portion 40 is disposed on one side of the socket 10. In this embodiment the portion of the socket which lines up with the gas discharge tube (not shown) has a width w which corresponds to the width of a standard socket. A side of the housing is expanded to create the expanded portion 40 on one side yielding a width w'.

The fourth embodiment 4 has a central portion which corresponds to the dimensions, including width w, of a standard socket and has expanded portions 40 extending widthwise in from both sides of the socket 10. The expanded portions 40 increase the overall width of the housing to w'. The control module 50 may be disposed in on expanded portion 40 and the lamp driver 20 can be disposed in the other expanded portion 40 separate from the control module 50.

In both the third and fourth embodiments the housing 30 is expanded in a direction substantially perpendicular to the axis of the gas discharge tube which is to be connected.

Figure 5:
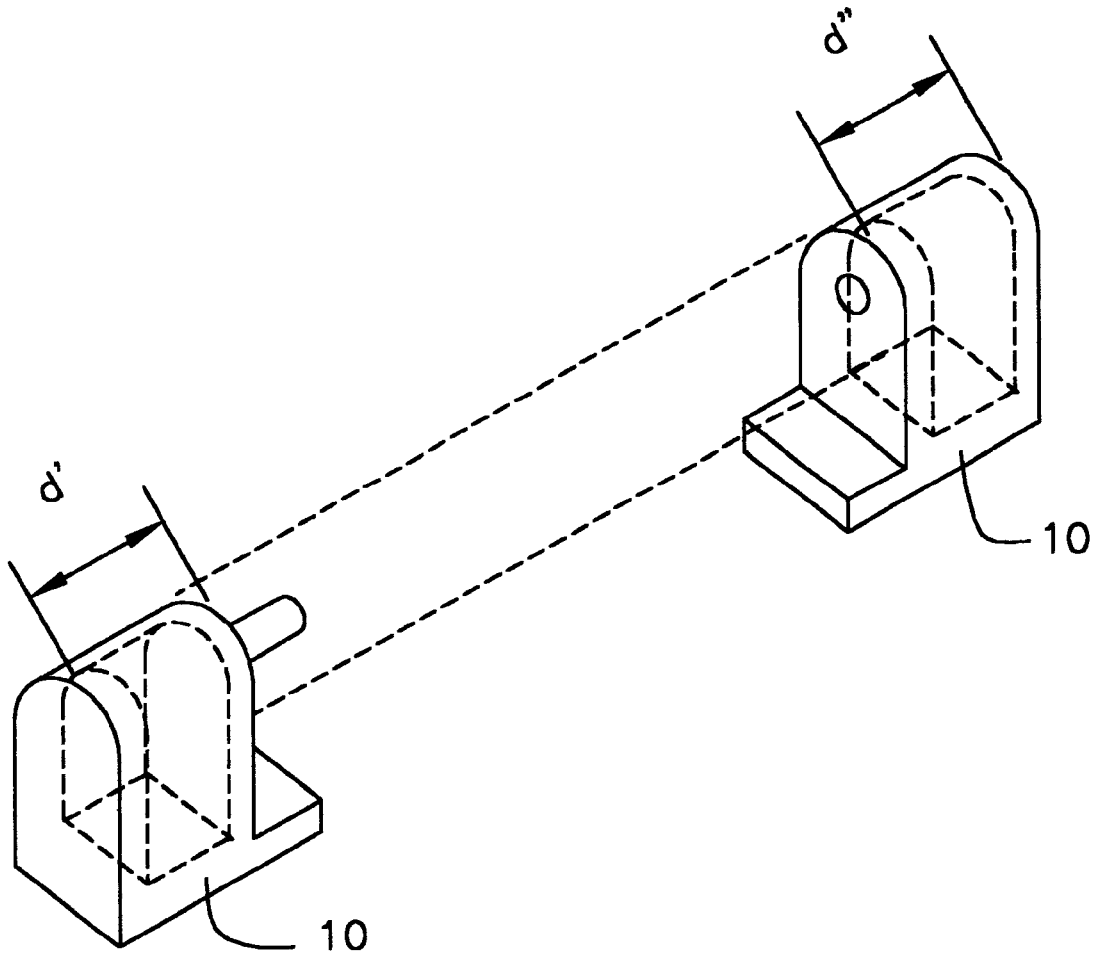
FIG. 5 is a perspective view of two sockets according to the present invention, both of which have increased depth.

FIG. 5 shows two sockets 10, both of which have had their depth increased to d' and d", respectively. Such a configuration permits the placement of the circuitry, namely the lamp driver and/or controller, into both sockets, thereby isolating heat sources.

In each of the foregoing embodiments the housing 30 contains the lamp driver circuitry including an oscillator, power semiconductors, and protective and filter circuitry. In addition, the system may include a control module 50, mounted remotely from said socket, where the control module 50 receives alternating current and provides filtering, power factor correction and voltage conversion circuitry to supply direct current to the socket 10. Alternatively, the control module may receive alternating current and supply alternating current to said socket. In yet another arrangement, the control module, may receive direct current and supply direct current or alternating current to the socket 10.

Having described several embodiments of the lamp socket in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A lighting system comprising:

a gas discharge tube having electrical contacts, said gas discharge tube configured to produce visible light when a specified voltage is applied to said electrical contacts;

a fixture having a pair of mounting means disposed therein, said pair of mounting means disposed at a distance from each other, said distance corresponding to said length of said gas discharge tube;

first and second lamp sockets, each said socket configured to be mounted in one of said pair of mounting means, each said socket having a first face substantially perpendicular to an axis of said gas discharge tube and a second face opposite said first face, said first face of each said socket configured such that said electrical contact of said gas discharge tube is insertable therein;

lamp drive circuitry, including an oscillator, power semiconductors, and protective and filter circuitry, said lamp drive circuitry housed in said at least one socket in a region extending towards said second face of said at least one socket.

2. The system according to claim 1, wherein said lamp drive circuitry is disposed in a region extending from said second face of both said sockets.

3. The system according to claim 1, further comprising a control module, mounted remotely from said socket, said control module receiving alternating current and configured to provide filtering, power factor correction and voltage conversion circuitry to supply direct current to said socket.

4. The system according to claim 1, further comprising a control module, mounted remotely from said socket, said control module receiving alternating current and configured to provide filtering, power factor correction and voltage conversion circuitry to supply alternating current to said socket.

5. The system according to claim 1, further comprising a control module, mounted remotely from said socket, said control module receiving direct current and configured to provide filtering, power factor correction and voltage conversion circuitry to supply direct current to said socket.

6. The system according to claim 1, further comprising a control module, mounted remotely from said socket, said control module receiving direct current and configured to provide filtering, power factor correction and voltage conversion circuitry to supply alternating current to said socket.

* * * * *